US006050678A

United States Patent [19]

Yoshida

[11] Patent Number: 6,050,678

[45] Date of Patent: Apr. 18, 2000

[54] INK JET HEAD

[75] Inventor: Hitoshi Yoshida, Kounan, Japan

[73] Assignee: Brother Kogyo Kabushiki Kaisha, Nagoya, Japan

[21] Appl. No.: 08/923,404

[22] Filed: Sep. 4, 1997

[30] Foreign Application Priority Data

Sep. 18, 1996 [JP] Japan ..... 8-245982

[51] Int. Cl.[7] ..... B41J 2/045

[52] U.S. Cl. ..... 347/70

[58] Field of Search ..... 347/68–71

[56] References Cited

U.S. PATENT DOCUMENTS 5,604,522 2/1997 Miura et al. ..... 347/70

5,684,520 11/1997 Morikoshi et al. ..... 347/70

5,956,829 9/1999 Kitahara et al. ..... 29/25.35

*Primary Examiner*—John Barlow

*Assistant Examiner*—Craig A. Hallacher

*Attorney, Agent, or Firm*—Oliff & Berridge, PLC

[57] ABSTRACT

The value C defined between the width W1 of the ink chamber 2 and the width W2 of the piezoelectric element portion 7 disposed on the vibrating sheet 5, which is obtained based on an equation; C=(W1−W2)/(2×W2), is set in a range of 0.5 to 0.8. This value C=(W1−W2)/(2×W2) is an index value of an allowable range of displacement amount of the piezoelectric element portion 7, in which the ink ejecting speed is not influenced by the displacement when the piezoelectric element portion 7 is arranged on the vibrating sheet 5 with the displacement from a center of an upper plane of the ink chamber 2.

1 Claim, 5 Drawing Sheets

INK JET HEAD

BACKGROUND OF THE INVENTION

1. Field of the Invention

The present invention relates to an ink jet head in which a plurality of ink chambers are formed in a cavity plate and are covered with a sheet material, and piezoelectric elements are disposed on the sheet material so as to correspond to the ink chambers, respectively. More particularly, the present invention relates to an ink jet head having a predetermined relation between a width of the ink chamber and a width of the piezoelectric element disposed on the ink chamber, whereby it can maintain the speed of ink ejecting from the ink chamber within an allowable range without lowering it even if the piezoelectric element is arranged in a position displaced from a proper position on the corresponding ink chamber.

2. Description of Related Art

Heretofore, regarding an ink jet head which ejects ink droplets via a nozzle from a selected ink chamber upon application of a driving voltage to a piezoelectric element mounted on the ink chamber, a number of researches have been made on a relation between the speed of the ink droplet when ejected from the nozzle and a pulse width of the driving voltage to be applied to the piezoelectric element. It is generally well known that the ejecting speed of the ink droplet ejected from the nozzle varies periodically according to the width of pulses of the driving voltage to be applied to the piezoelectric element.

For example, in the case where a driving voltage with various pulse widths is applied to a piezoelectric element to press a selected one of ink chambers in an ink jet head thereby to eject an ink droplet from a nozzle of the ink chamber, the relation shown by a curved line S in FIG. 6 exists between the ejecting speed of the ink droplet and the pulse widths P of the driving voltage. At this time, if the time needed for a pressure wave of ink, which is generated when the ink chamber is pressed, to travel by a length of the ink chamber is considered as T, the first maximum point K1 of the curved line S (the left maximum point in FIG. 6) indicates that the pulse width P of the driving voltage corresponds to the time T and the second maximum point K2 (the right maximum point in FIG. 6) indicates that the pulse width P corresponds to the time 3T which is three times the time T.

In conventional ink jet heads, therefore, such the pulse widths P of a driving voltage for driving each piezoelectric element are selectively set based on the above mentioned relationship between the ejecting speed of an ink droplet and the pulse width P of the driving voltage to be applied to the piezoelectric element.

Meanwhile, the time T needed for a pressure wave of the ink in the ink chamber when pressed to travel by the length of the ink chamber is defined by an equation; $T=L/(\sqrt{Ev/\rho})$, wherein "L" represents a length of an ink chamber (see FIG. 1), Ev represents apparent volume modulus of the ink in the ink chamber, and ρ represents the density of the ink. It is noted that the volume modulus Ev changes according to an amount of deformation of the ink chamber when pressed, namely, an amount of deformation of each wall forming the ink chamber in the cavity plate and a sheet material on which the piezoelectric element is mounted in contact with it. This volume modulus Ev has a property of becoming smaller as the deformation amount of each ink chamber wall and that of the sheet material are larger.

In particular, the irregular deformation of the sheet material (a vibrating sheet) on which the piezoelectric element is mounted, which is caused by application of a driving voltage to the piezoelectric element, may largely affect the volume modulus Ev. This causes the change in the time T and a bad influence.

Here, the relationship between the width of a piezoelectric element arranged on the sheet material and the width of an ink chamber in a conventional ink jet head will be explained with reference to FIG. 7. FIG. 7 is an explanatory view of schematically showing the relation between the width of the piezoelectric element and the width of the ink chamber in the conventional ink jet head. In FIG. 7, an ink chamber 21 is formed in a cavity plate 20. A sheet material 22 serving as a vibrating sheet is arranged on an open (upper) plane of the ink chamber 21. Further, a piezoelectric element portion 24 formed in a piezoelectric plate 23 is arranged on the sheet material 22 so as to correspond to the ink chamber 21. With such the structure, to render the deformation of the sheet material 22 uniform in both sides of the piezoelectric element portion 24 when a driving voltage is applied to the piezoelectric element portion 24, it is preferable to dispose the piezoelectric element portion 24 in a center of the upper plane of the ink chamber 21. In other words, in the case of considering the width of the ink chamber 21 as "A" and the width of the piezoelectric element portion 24 as "B", it is desirable to form an interval of (A−B)/2 in each side of the piezoelectric element 24.

The aforesaid ink jet heads, however, are usually ordered to form an interval into about several μm in each side of the piezoelectric element portion 24. When there is a small displacement among the cavity plate 20, the sheet material 22, and the piezoelectric plate 23 in assembling them, a difference occurs in the deformation amount of the sheet material 22 between both sides of the piezoelectric element portion 24.

For example, examining the relationship between the amount of displacement of the piezoelectric element portion 24 on the sheet material 22 from the center of the upper plane of the ink chamber 21 and the time T needed for a pressure wave of the ink to travel by a length of the ink chamber 21, we obtained the relation shown in FIG. 8. FIG. 8 is a graph showing the relationship between the displacement amount of the piezoelectric element portion 24 and the time T, wherein a lateral axis represents an amount (μm) of displacement of the piezoelectric element portion 24 from the center in the upper plane of the ink chamber 21 and a vertical axis represents a time T (μs).

As clearly from FIG. 8, it is found that the time T increases as the amount of displacement of the piezoelectric element portion 24 disposed on the sheet material 22 becomes larger. For instance, the time T is about 7.5 μs when the displacement amount of the piezoelectric element portion 24 is "0", while the time T increases, specifically to about 8.4 μs, when the displacement amount (represented by D) is about 35 μm.

An increase of the time T means that the travelling speed of the pressure wave of the ink in the ink chamber decreases, causing a decrease in the ejecting speed of the ink when ejected from the nozzle of the ink chamber. This is explained referring to FIG. 9. FIG. 9 is a graph showing the relationship between the pulse width P of the driving voltage and the ink ejecting speed V, in which a lateral axis represents a pulse width P (μs) and a vertical axis represents an ink ejecting speed V (m/s) respectively.

In FIG. 9, if the displacement amount of the piezoelectric element portion 24 is "0", i.e., the piezoelectric element portion 24 is properly placed in the center of the upper plane of the ink chamber 21, the relation between the pulse width P and the ejecting speed V is shown by the curved line S1 indicated by a solid line. If the displacement amount is D, i.e., the piezoelectric element portion 24 is placed in a position displaced by an amount of "D" from the center of the upper plane of the ink chamber 21, the relation is shown by the curved line S2 indicated by a broken line. Since the pulse width P of the driving voltage is usually determined to a predetermined pulse width, in the case that the pulse width P is 3T, the ejecting speed is "V1" in the curved line S1, while the speed is reduced to "V2" in the curved line S2.

As described above, the ink ejecting speed is reduced due to the displacement amount of the piezoelectric element portion 24, which causes unstable performance of the ink jet head. As a result thereof, it is not possible to maintain stable and high print quality.

SUMMARY OF THE INVENTION

The present invention has been made in view of the above circumstances and has an object to overcome the above problems and to provide an ink jet head capable of keeping the ink ejecting speed within an allowable range without reducing the same by establishing the relationship between the width of an ink chamber and the width of a piezoelectric element mounted on a sheet material disposed on the ink chamber even when the piezoelectric element is placed in a position displaced from a proper position corresponding to the ink chamber, thus capable of performing recording with high print quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet head of this invention comprising a cavity plate in which a plurality of ink chambers are formed, a sheet material covering each upper surface of the ink chambers, piezoelectric elements disposed on the sheet material, each of which corresponds to each of the ink chambers, and a nozzle plate in which nozzles are formed, each of the nozzles communicating with each of the ink chambers, the ink jet head ejecting ink droplets from the nozzles in accordance with a change in pressure of the ink chambers caused by application of a driving voltage to each of the piezoelectric elements, to print characters on a sheet, wherein a value C defined between a width W1 of the ink chamber and a width W2 of the piezoelectric element disposed on the sheet material, which is obtained by an equation; $C=(W1-W2)/(2\times W2)$, is set to 0.5 or more.

In the ink jet head of the present invention, the value $C=(W1-W2)/(2\times W2)$ is the target value of an allowable displacement range in which no influence is exerted on the ink ejecting speed even if the piezoelectric element is mounted in a position displaced from the center of the ink chamber when the piezoelectric element having a width of W2 is disposed on and in contact with a sheet material, corresponding to an ink chamber having a width of W1.

It is noted that a numerator; (W1−W2) of the above formula defining the value C represents intervals left in both sides of the piezoelectric element having a width W2, arranged on the sheet material. As this value of intervals is larger, compensation capacity with respect to the displacement amount of the piezoelectric element increases. In other words, the displacement amount of the piezoelectric element can be absorbed into the intervals, so that the influence on the ink ejecting speed is reduced. A coefficient "2" in a denominator; (2×W2) of the above formula is determined in consideration of that the intervals are given in both sides of the piezoelectric element. As the value C is larger, accordingly, the allowable displacement range of the piezoelectric element becomes larger, reducing the influence of the displacement of the piezoelectric element on the ink ejecting speed. As the value C is smaller, on the other hand, the allowable displacement range becomes smaller, increasing the influence of the displacement on the ink ejecting speed.

It is possible to reduce the influence caused by the displacement amount of the piezoelectric element on the ink ejecting speed when the value C is 0.5 or more. Accordingly, even when the piezoelectric element is arranged corresponding to the ink chamber in a position displaced from a proper position, the ink jet head of the present invention can maintain the ink ejecting speed within an allowable range without reducing it, thereby performing recording with high print quality.

According to another aspect of the invention there is provided an ink jet head wherein the value C is set to 0.8 or less.

In this ink jet head of the invention, a predetermined relationship is established between both widths of the ink chamber and the piezoelectric element disposed on the sheet material, so that the ink ejecting speed can be maintained within an allowable range without decreasing even when the piezoelectric element is placed corresponding to the ink chamber with displacement from a proper position. The present invention can thus provide an ink jet head which perform printing with good quality.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
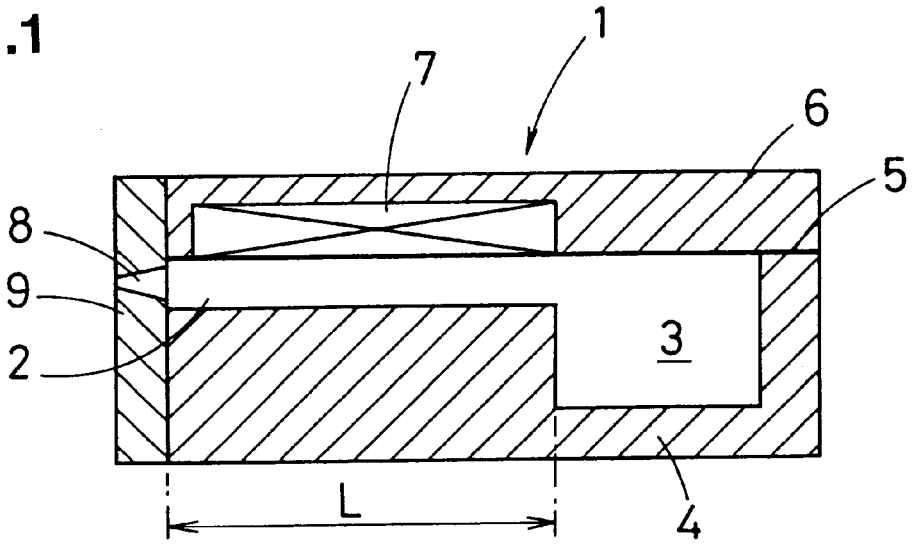
FIG. 1 is a side sectional view of an ink jet head in an embodiment according to the present invention.

A detailed description of one preferred embodiment of an ink jet head embodying the present invention will now be given referring to the accompanying drawings. At first, the structure of the ink jet head is schematically described with reference to FIGS. 1 and 2. FIG. 1 is a side sectional view of the ink jet head and FIG. 2 is a front view of the same from which a nozzle plate is omitted to facilitate the explanation.

Figure 2:
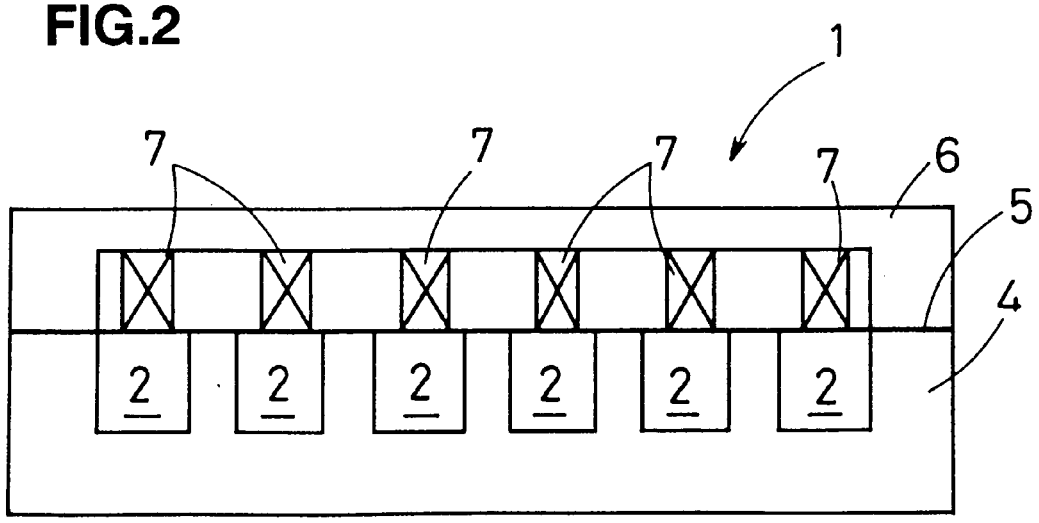
FIG. 2 is a front view of the ink jet head from which a nozzle plate is omitted.

In FIGS. 1 and 2, an ink jet head 1 has a cavity plate 4 formed of an alumina sintered body in which a plurality of ink chambers 2 with a length "L" and ink manifolds 3 which communicate with the ink chambers 2 respectively are formed through a cutting work. Each ink manifold 3 is supplied with ink from an ink supply unit (not shown) mounted on an ink jet printer and supplies the ink to the ink chamber 2. On an upper plane of the cavity plate 4 is adhered a vibrating sheet 5 formed of aramid film for shielding the upper faces of the ink chamber 2 and the ink manifold 3.

A piezoelectric plate 6 formed of piezoelectric material such as PZT and the like is disposed on an upper surface of the vibrating sheet 5, above the cavity plate 4. This piezoelectric plate 6 is provided therein with a plurality of piezoelectric element portions 7, each of which corresponds to each ink chamber 2 and the lower plane of which is in contact with the vibrating sheet 5. The piezoelectric element portion 7 is provided with a predetermined electrode pattern not shown, whereby it vibrates downward as shown in FIGS. 1 and 2 upon application of driving voltage to the electrode pattern, to press the vibrating sheet 5, thus applying a pressure o the ink chamber 2 corresponding to the piezoelectric element portion 7. Here, since such the piezoelectric plate 6 and the piezoelectric element portion 7 are well known in the prior art, the detail explanation of them is omitted in the specification.

A nozzle plate 9 is fixedly mounted on a front end face of the ink jet head 1, i.e., a left end face in FIG. 1, and is provided with a plurality of nozzle orifices 8. Each of the nozzle orifices 8 communicates with a corresponding ink chamber 2. Upon application of a driving voltage to a selected piezoelectric element portion 7, the vibrating sheet 5 is pressed to deform an ink chamber 2 corresponding to the piezoelectric element portion 7, thus ejecting an ink droplet from the ink chamber 2 through the nozzle orifice 8 of the nozzle plate 9. As a result, characters and the like are printed on a sheet arranged facing the ink jet head 1.

Figure 3:
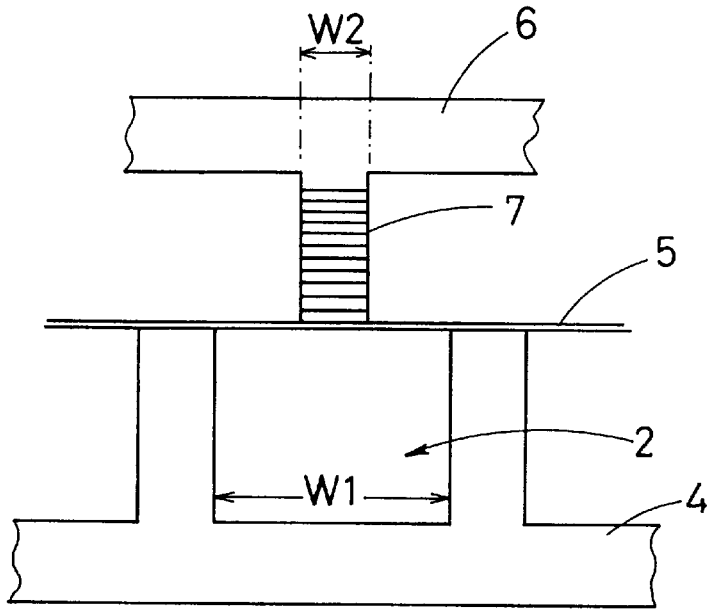
FIG. 3 is an explanatory view schematically showing the relationship between the width of a piezoelectric element portion and that of an ink chamber in the ink jet head.

Next, the relationship between a width of the piezoelectric element portion 7 mounted on the vibrating sheet 5 ad that of the ink chamber 2 in the ink jet head 1 constructed as above will be explained with reference to FIG. 3. FIG. 3 is an explanatory view schematically showing the above relationship.

The width of the ink chamber 2 is set to "W1" and that of the piezoelectric element portion 7 to "W2" respectively in FIG. 3. Between those widths "W1" and "W2", a value C defined by an equation: $(W1-W2)/(2\times W2)$ is set to 0.5 or more and 0.8 or less. For example, if setting the width "W1" to 260 $\mu$m and the width "W2" to 100 $\mu$m, the value C is 0.8 from the equation; $(260-100)/(2\times 100)$. Note that concrete values of the widths "W1" and "W2" can be changed based on the range of the value C.

Figure 4:
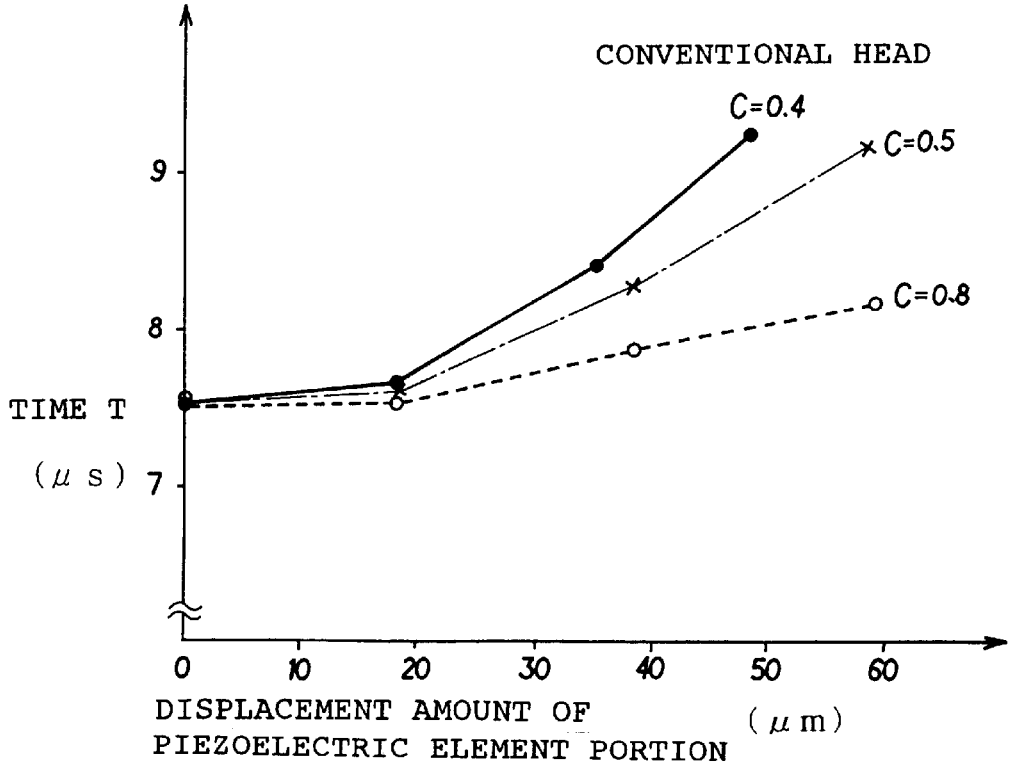
FIG. 4 is a graph showing the relationship between the amount of displacement of the piezoelectric element portion and the time T.

Furthermore, with various values C, it was examined that the relationship between an amount of displacement of the piezoelectric element portion 7 arranged on the vibrating sheet 5 from a center of an upper plane of the ink chamber 2 and a time T necessary for a pressure wave of ink to travel by the length "L" in the ink chamber 2. The result thereof is shown in FIG. 4. FIG. 4 is a graph showing the relationship between the displacement amount of the piezoelectric element portion 7 and the time T, where a lateral axis indicates an amount of displacement ($\mu$m) of the piezoelectric element portion 7 from the center of the upper plane of the ink chamber 2 and a vertical axis indicates a time T ($\mu$s).

As shown in FIG. 4, the time T increases as the displacement amount of the piezoelectric element portion 7 increases, and the variation rate of the time T decreases as the value C becomes larger. In the ink jet head in the prior art, for example, the value C is almost set to about 0.4. When the value C is about 0.4 in this way, the time T is about 7.5 $\mu$s when the displacement amount of the piezoelectric element portion 7 is "0", while the time T increases up to about 9.2 $\mu$s when the displacement amount is 50 $\mu$m, as indicated by a solid line in FIG. 4. In this case, the rate of variation in time T becomes 22.6% based on a formula; $(9.2-7.5)/7.5\times 100$.

In the case that the value C is about 0.5, as indicated by a one-dot line in FIG. 4, the time T is about 7.5 $\mu$s when the displacement amount is "0", while the time T becomes about 8.7 $\mu$s when the displacement amount is about 50 $\mu$m. In this case, the rate of variation in time T becomes 16.0% based on the formula; $(8.7-7.5)/7.5\times 100$. Furthermore, in the case that the value C is about 0.8, as indicated by a broken line in FIG. 4, the time T is about 7.5 $\mu$s when the displacement amount is "0", while the time T is about 8.0 $\mu$s when the displacement amount is about 50 $\mu$m. In this case, the rate of variation in time T becomes 6.6% based on the formula; $(8.0-7.5)/7.5\times 100$.

As clearly from the relationship mentioned above, for example, to reduce the variation rate of the time T below 20% when the amount of displacement of the piezoelectric element portion 7 is 50 $\mu$m or less, it is desirable to set the value C to 0.5 or more. When the value C is 1.0 or more, the width W2 of the piezoelectric element portion 7 is extremely narrow as compared with the width W1 of the ink chamber 2, reducing the area of the piezoelectric element portion 7 occupied on the vibrating sheet 5 corresponding to the ink chamber 2. In this case, it takes the pressure wave of ink time to travel in the ink chamber 2 even if the vibrating sheet 5 is depressed through the piezoelectric element portion 7. The time T thus becomes considerably larger than 7.5 $\mu$s even when the displacement amount of the piezoelectric element portion 7 is "0", which is not preferable. In consideration of the above, the maximum of the value C is set to about 0.8.

Figure 5:
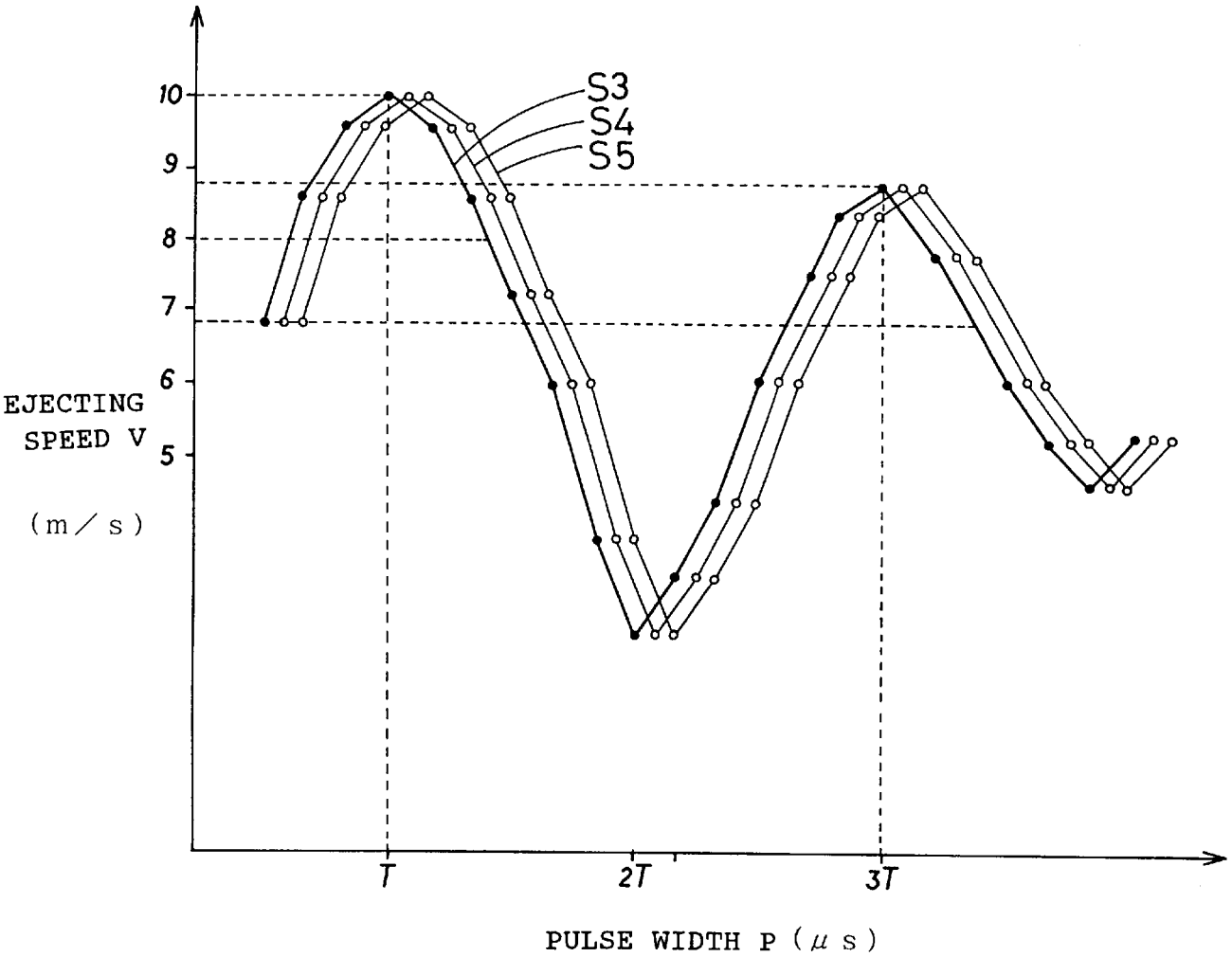
FIG. 5 is a graph showing the relationship between the pulse width P of a driving voltage and the ink ejecting speed
Figure 6:
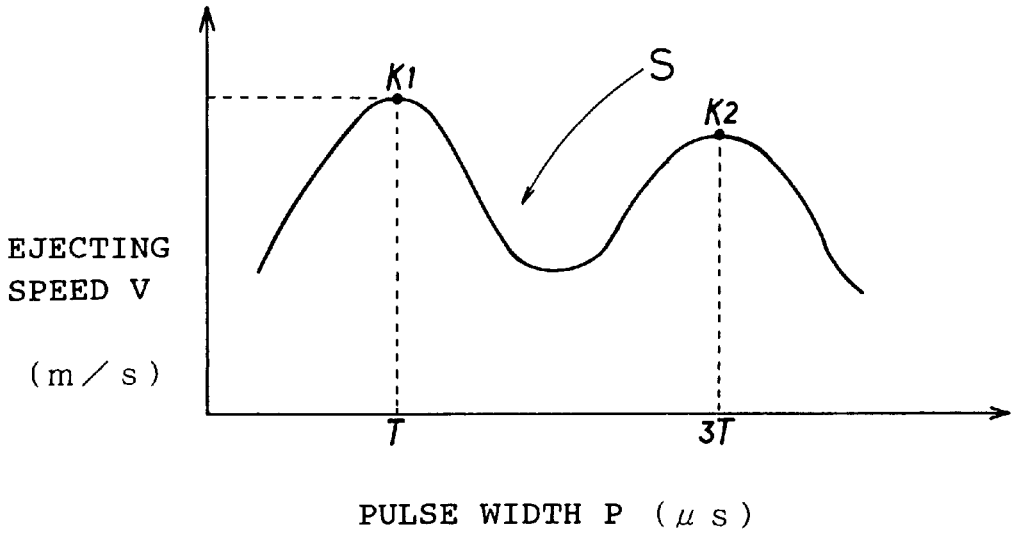
FIG. 6 is a graph shown the relationship between the pulse width P and the ink ejecting speed V in a conventional ink jet head.
Figure 7:
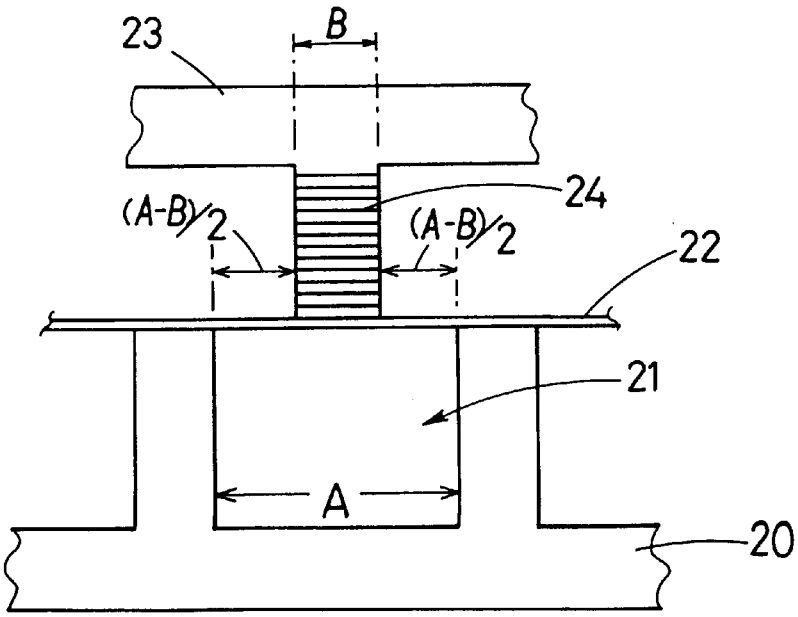
FIG. 7 is an explanatory view schematically showing the relationship between the width of a piezoelectric element and the width of an ink chamber in the conventional ink jet head.
Figure 8:
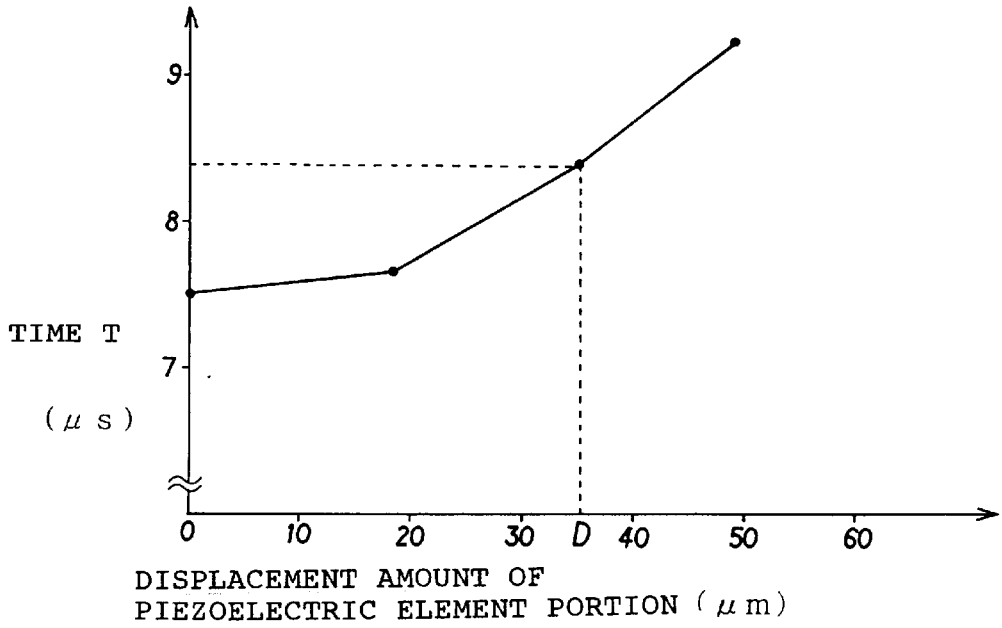
FIG. 8 is a graph showing the relationship between the amount of displacement of the piezoelectric element portion and the time T in the conventional ink jet head.
Figure 9:
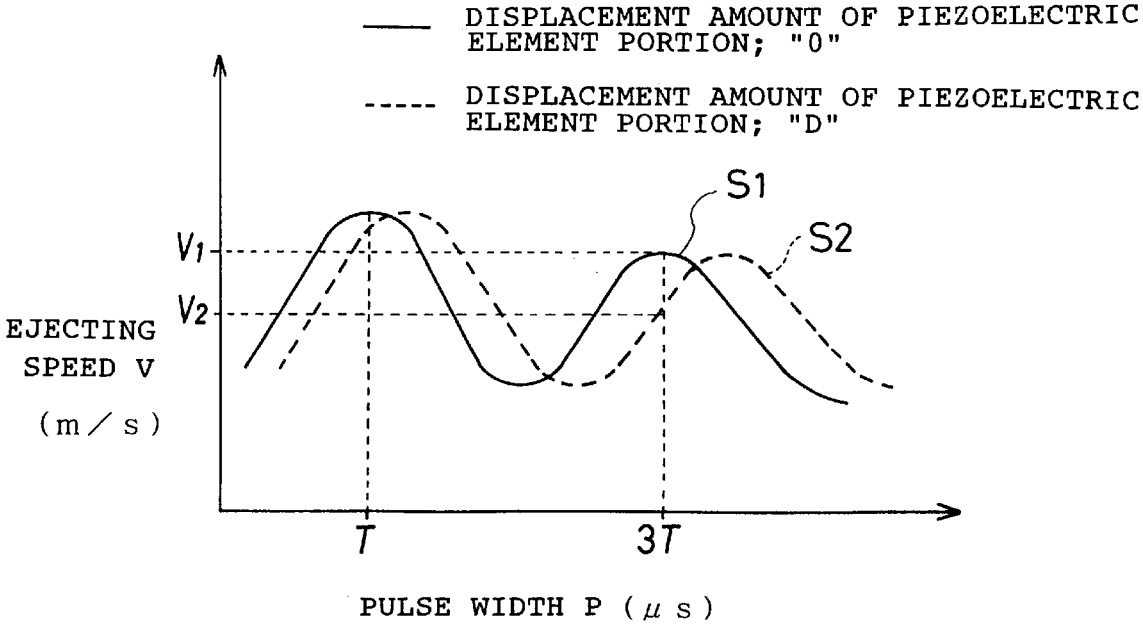
FIG. 9 is a graph showing the relationship between the pulse width P of the driving voltage and the ink ejecting speed V in the conventional ink jet head.

Increase of the time T as mentioned above means decrease of a travelling speed of a pressure wave of the ink in the ink chamber, thereby reducing the ejecting speed of the ink ejected from the nozzle. To disclose such a mutual relation, the relationship between the pulse width P of a driving voltage and the ink ejecting speed v in connection with each value C mentioned above will be explained referring to FIG. 5. FIG. 5 is a graph showing the relation between the pulse width P and the ink ejecting speed V, where a lateral axis indicates a pulse width P ($\mu$s) and a vertical axis indicates an ejecting speed V (m/s).

In FIG. 5, curved lines S3, S4, and S5 show the relation between the pulse width P and the ink ejecting speed V when the value C are 0.5, 0.8, and 1.0, respectively.

In the curved line S3, the ejecting speed V is 10.0 m/s and 8.8 m/s when the pulse width P is time T and 3T, respectively. Similarly, in the curved line S4, the ejecting speed V is 9.8 m/s and 8.6 m/s when the pulse width P is time T and 3T, respectively. In the curved line S5, the ejecting speed v is 9.6 m/s and 8.4 m/s when the pulse width P is time T and 3T, respectively. Based on the above relation, if the value C is set in a range of 0.8 to 0.5, variation in the ejecting speed when the pulse width P is time T can be reduced to about 4% with respect to the case that the value C is 1.0. Similarly, when the pulse width P is a time 3T, variation in the ejecting speed can be reduced to about 4.5% with respect to the case that the value C is 1.0.

If setting the value C in a range of 0.8 to 0.5, as mentioned above, it is possible to reduce the variation in the ink ejecting speed V, which is caused by displacement of the piezoelectric element portion 7 with respect to the ink chamber 2.

As described above, the ink jet head 1 according to the present embodiment, the value C defined between the width W1 of the ink chamber 2 and the width W2 of the piezoelectric element portion 7, which is obtained from the equation; $C=(W1-W2)/(2\times W2)$, is set in a range from 0.5 to 0.8. This value $C=(W1-W2)/(2\times W2)$ is an index of an allowable range of displacement amount of the piezoelectric element portion 7 having a width W2 when it is arranged on the vibrating sheet 5, corresponding to the ink chamber 2 having a width W1, in which no influence is exerted on the ink ejecting speed even if the piezoelectric element portion 7 is displaced from the center of the ink chamber 2. If this value C is set in a range of 0.5 to 0.8, it is possible to reduce the influence caused by the displacement amount of the piezoelectric element portion 7 with respect to the ink chamber 2 on the ink jetting speed V.

Consequently, even when the piezoelectric element portion 7 is mounted above a corresponding ink chamber 2 with displacement from a proper position, the ink ejecting speed V can be maintained within an allowable range without being lowered, so that the ink jet head of the invention can perform printing with good quality.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet head comprising a cavity plate in which a plurality of ink chambers are formed, a sheet material covering the ink chambers, piezoelectric elements disposed on the sheet material, each of which corresponds to each of the ink chambers, and a nozzle plate in which nozzles are formed, each of the nozzles communicating with each of the ink chambers, the ink jet head ejecting ink droplets from the nozzles in accordance with a change in pressure of the ink chambers caused by application of a driving voltage to each of the piezoelectric elements, to print characters on a sheet, wherein a value C defined between a width W1 of the ink chamber and a width W2 of the piezoelectric element disposed on the sheet material, which is obtained by an equation; $C=(W1-W2)/(2\times W2)$, is set in a range of 0.5 to 0.8.

* * * * *